United States Patent [19]

Buchanan

[11] Patent Number: 4,977,739

[45] Date of Patent: Dec. 18, 1990

[54] METHOD AND APPARATUS FOR MAKING COMPOSITE YARN

[75] Inventor: Douglas R. Buchanan, Odessa, Canada

[73] Assignee: Du Pont Canada Inc., Mississauga, Canada

[21] Appl. No.: 371,184

[22] Filed: Jun. 26, 1989

[51] Int. Cl.[5] ..... D02G 3/26; D02G 3/28; D01H 7/92

[52] U.S. Cl. ..... 57/293; 57/204; 57/350

[58] Field of Search ..... 57/293, 294, 350, 204, 57/205, 352, 328

[56] References Cited

U.S. PATENT DOCUMENTS

| | | | |
|---|---|---|---|
| 3,434,275 | 3/1969 | Backer et al. | 57/204 |
| 3,468,120 | 9/1969 | Hildebrand | 57/293 |
| 3,775,955 | 12/1973 | Shah | 57/293 |
| 4,055,040 | 10/1977 | Lin | 57/293 X |
| 4,074,511 | 2/1978 | Chambley et al. | 57/293 |
| 4,170,103 | 10/1979 | Norris et al. | 57/293 |
| 4,206,589 | 6/1980 | Markey et al. | 57/293 |
| 4,246,750 | 1/1981 | Norris et al. | 57/204 X |
| 4,276,740 | 7/1981 | Chambley et al. | 57/205 |

FOREIGN PATENT DOCUMENTS

| | | |
|---|---|---|
| 924088 | 4/1963 | United Kingdom . |
| 1047503 | 11/1966 | United Kingdom . |

*Primary Examiner*—John Petrakes

[57] ABSTRACT

A composite yarn comprising at least two yarn bundles plied together in alternating S and Z composite directions of twist separated by composite nodes of zero twist. At least one of the yarn bundles is a multi-strand bundle comprising at least two yarn strands. The strands of the bundles are twisted and the strands of the multi-strand bundle are plied together in alternating S and Z bundle directions of twist separated by bundle nodes of zero twist. The composite nodes and the bundle nodes coincide and the composite direction of twist is opposite to said bundle direction of twist between nodes. A method of plying filaments to obtain the composite yarn and apparatus for doing so are also disclosed.

5 Claims, 1 Drawing Sheet

METHOD AND APPARATUS FOR MAKING COMPOSITE YARN

BACKGROUND OF THE INVENTION

This invention relates to a composite yarn and a method and apparatus for making this yarn.

U.S. Pat. Nos. 3,468,120 and 4,055,040 (E.I. du Pont) both disclose a method of producing alternate twist yarn wherein individual strands are kept separate and individually twisted in alternating S and Z directions and are then plied together by passing them through a compression tube. In this tube, the yarns partially untwist and wrap around each other in the opposite direction to the direction of twist of the individual filaments.

It is desired to provide a yarn having improved resiliancy and a unique appearance.

SUMMARY OF THE INVENTION

The present invention provides a composite yarn comprising at least two yarn bundles plied together in alternating S and Z composite directions of twist separated by composite nodes of zero twist. At least one of said yarn bundles is a multistrand bundle comprising at least two yarn strands, said strands being plied together in alternating S and Z bundle directions of twist separated by bundle nodes of zero twist. The composite nodes and the bundle nodes coincide and the composite direction of twist is opposite to said bundle direction of twist between nodes.

In another one of its aspects, the invention provides a method of plying yarns to obtain a composite yarn. The first step is to separate at least three spaced, parallel strands of yarn into at least two bundles at least one of which is a multi-strand bundle having at least two strands. Tension is applied to the strands and the strands of each multi-strand bundle are then converged while the bundles are kept separate from one another. Alternating twisting means are simultaneously applied to twist the strands of the bundles and ply the strands of each multi-strand bundle together in alternating S and Z bundle directions of twist separated by nodes. The bundles are then converged in a restricted area to cause said bundles to partially untwist and therey ply together in a composite direction of twist opposite to said bundle direction of twist to produce said composite yarn.

In a still further one of its aspects, the invention provides an apparatus for making a composite yarn. The apparatus comprises guide means for guiding at least three spaced parallel strands and separation means for separating said strands into at least two bundles, at least one of which is a multi-strand bundle having at least two strands. Tensioning means for applying equal tension to the yarns is provided. Twisting means for twisting the strands in alternating S and Z bundle direction of twist between filament nodes of zero twist are also provided. First converging means for converging the strands of each multi-strand bundle is located between the guide means and the twisting means. Second converging means is located after the twisting means for converging the bundles in a restricted area and allowing the bundles to partially untwist and ply together in a composite direction of twist, which is opposite to the bundle direction of twist.

This novel method and apparatus for twisting yarn provides yarn with two levels of twist. The composite yarn is generally stronger than the individual yarns used to make it and so is ideal for use as sewing thread or weaving yarn in high strength applications. This yarn may also be used to make carpet which is more resiliant than and has a different appearance than conventional carpet made from the same type of fibre.

DESCRIPTION OF THE PREFERRED EMBODIMENTS

Figure 1:
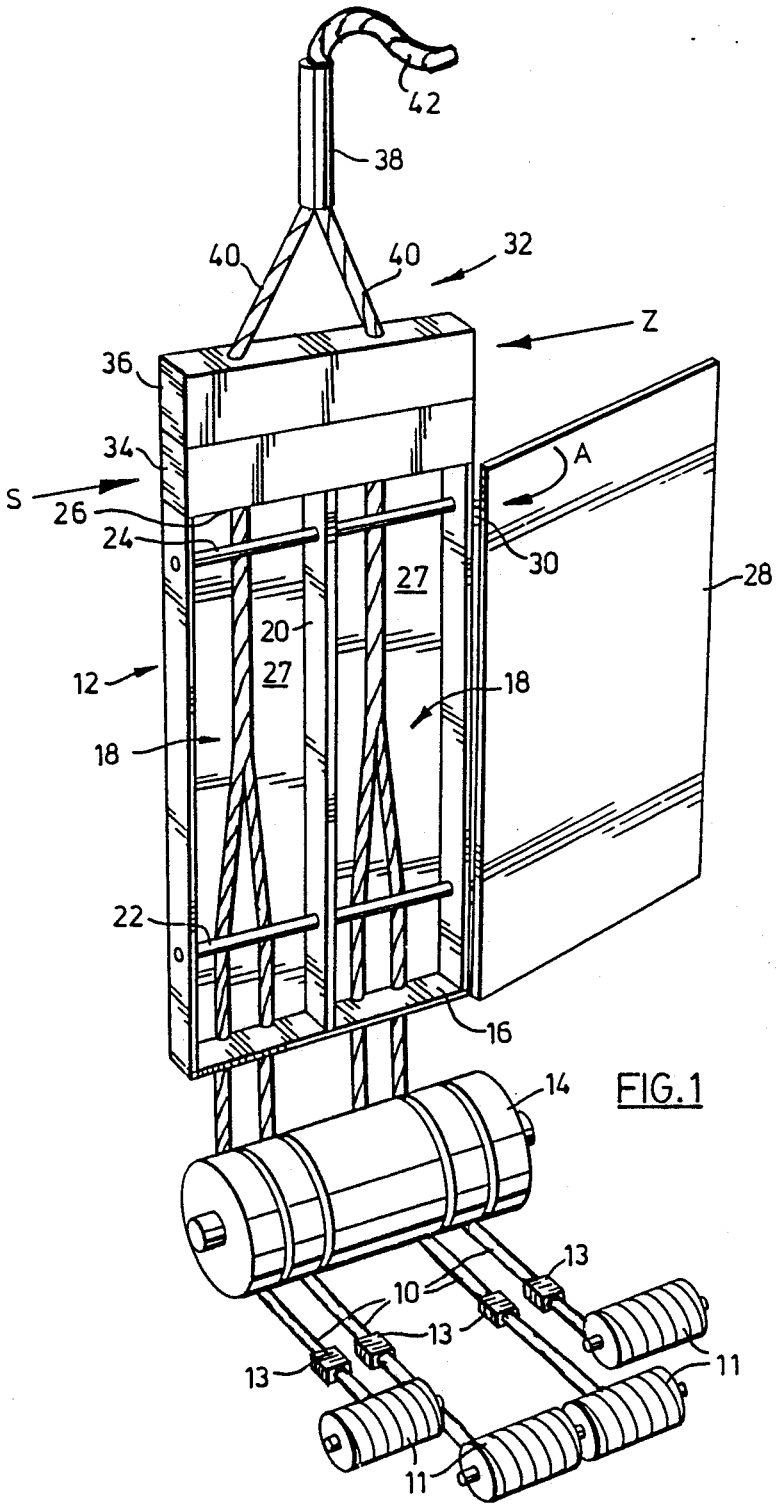

Practically any type of fibre may be used in accordance with the present invention, for example nylon, spandex, polyester, polyolefin, carbon fibre, hemp, jute and cotton. The filaments used to make the yarn may be made of different materials from one another and may be of different deniers and densities. Also, the number of filaments in each composite yarn bundle do not need to be the same. For example, in a composite yarn made up of two bundles, one bundle may have only one strand and the other bundle may have two or more strands.

The invention will be further described with respect to the following drawings in which FIG. 1 is a diagrammatic representation of an apparatus for making a composite yarn.

FIG. 1 shows four spaced, parallel strands 10 of yarn being unwound from packages 11. An equal amount of tension is applied to each strand 10 by tensioning devices 13 before the strands 10 enter an apparatus 12 for making composite yarn. The apparatus comprises a separation roll 14 for guiding and separating the individual filaments, above which is located an alignment guide 16. The guide 16 leads to a pair of passages 18 separated by a separation plate 20. A first retaining pin 22 is located adjacent to the guide 16 in the passage and a second retaining pin 24 is located above the first pin 22 adjacent to the end 26 of the passages 18. Small gaps (not shown) are located between the pins 22, 24 and a rear plate 27 of the passages so that the strands 10 are squeezed between the pins and the plate 27 when they pass through the gaps. A cover plate 28 is mounted on hinges 30 adjacent to the passage and is rotatable in the direction indicated by arrow A to cover the passages 18.

A twisting apparatus 32 is located above the second retaining pin 24. This apparatus 32 comprises a lower air jet 34 for applying twist to the yarn in the S direction and an upper air jet 36 for applying twist to the yarn in the Z direction. These jets 34, 36 are alternately actuated for equal periods of time. A compression tube 38 is located above the twisting apparatus 32.

In operation, yarn strands 10 are unwound from each of the packages 11 and an equal amount of tension is applied to each of the strands by the tension devices 13. The strands are then guided into the apparatus 12 by the separation roll 14, which also helps to separate the strands from one another. The strands then pass through the alignment guide 16 which guides the strands into one or the other of the passages. The strands then pass through the gap between the first retaining pin 22 and the plate 27 and then through the gap between the second retaining pin 24 and the plate 27 and are thereby converged.

In the passages, the strands are twisted and plied together by the false twisting apparatus 32 in alternating S and Z bundle directions of twist, with equally spaced nodes of zero twist in between. The distance between nodes in the composite yarn is a function of the frequency with which the air jets are switched on and off and of the yarn forwarding speed. The level of twist is determined by the level of tension in the strands and the air pressure of the twisting means. By the time the converged strands pass the twisting apparatus 32, a pair of twisted bundles 40 of strands is created. The bundles then pass the twisting apparatus 32 and are converged by the compression tube 38. The yarn bundles are allowed to relax and partially untwist in the compression tube. The fact that the bundles are in close proximity to each other causes the bundles to untwist around each other. The bundles 40 are plied together in a direction of twist hereinafter called the composite direction of twist, which is opposite to the bundle direction of twist.

The composite yarn 42 leaving the compression tube 38 therefore has two levels of twist. Since the direction of twist of the bundles is always opposite to that of the strands, the nodes of the bundles and composite coincide.

Although only a composite yarn comprising two bundles comprising two strands each is shown, many other combinations of bundles and strands are possible. For example, a two bundle composite yarn comprising a single strand bundle and a three strand bundle may be used or a three bundle yarn comprising a pair of two strand bundles and a three strand bundle may be used.

What is claimed is:

1. A method of plying yarns to obtain a composite yarn comprising the steps:

of separating at least three spaced, parallel strands of yarn into at least two bundles, at least one of which is a multi-strand bundle having at least two strands;

applying a substantially equal amount of tension to the strands and converging the strands of the multi-strand bundle while keeping the bundles separate from one another;

simultaneously applying alternating twisting means to twist the strands and ply together the strands of each multi-strand yarn in alternating S and Z bundle directions of twist separated by nodes;

converging the bundles in a restricted area to cause said bundles to partially untwist and thereby ply together in a composite direction of twist opposite to said bundle direction of twist to produce said composite yarn.

2. An apparatus for making a composite yarn comprising:

guide means for guiding at least three spaced parallel strands;

tensioning means for applying substantially equal tension to said strands;

separation means for separating said strands into at least two bundles, at least one of which is a multi-strand bundle having at least two strands, twisting means for twisting each of the bundles in an alternating S and Z bundle direction of twist between filament nodes of zero twist;

first converging means for converging the strands of each multi-strand bundle located between said guide means and said twisting means;

second converging means located after said twisting means for converging said bundles in a restricted area and allowing said bundles to partially untwist and ply together in a composite direction of twist, which is opposite to the bundle direction of twist.

3. The apparatus of claim 2 wherein said second converging means comprises a compression tube.

4. The apparatus of claim 2 wherein said first converging means comprises a pair of spaced retaining pins.

5. The apparatus of claim 2 wherein said guide means comprises a plurality of spaced, longitudinally extending passages, wherein each bundle of strands passes through a separate one of said passages.

* * * * *